United States Patent [19]

Prodell

[11] Patent Number: 4,882,662

[45] Date of Patent: Nov. 21, 1989

[54] GRID OF LAMELLAE FOR A LAMP

[75] Inventor: Peter Prodell, Munich, Fed. Rep. of Germany

[73] Assignee: Siemens Aktiengesellschaft, Berlin and Munich, Fed. Rep. of Germany

[21] Appl. No.: 137,603

[22] Filed: Dec. 24, 1987

[30] Foreign Application Priority Data

Feb. 17, 1987 [DE] Fed. Rep. of Germany ..... 3705020

[51] Int. Cl.[4] ..... F21V 11/06

[52] U.S. Cl. ..... 362/290; 362/291; 362/354; 362/342

[58] Field of Search ..... 362/147, 148, 279, 290, 362/291, 325, 342, 354, 292, 298

[56] References Cited

U.S. PATENT DOCUMENTS

| | | | |
|---|---|---|---|
| 1,894,583 | 11/1933 | Ferree et al. | 362/291 |
| 2,143,149 | 1/1939 | Guth | 362/354 |
| 2,166,646 | 7/1939 | Sibbert | 362/354 |
| 2,398,624 | 4/1946 | Decker | 362/342 |
| 2,572,825 | 10/1951 | Guth | 362/325 |
| 3,076,892 | 2/1963 | Stiffel | 362/279 |
| 3,508,042 | 4/1970 | MacCoy | 362/342 |
| 4,222,094 | 9/1980 | Wolar | 362/279 |
| 4,780,800 | 10/1988 | Mullins | 362/290 |

FOREIGN PATENT DOCUMENTS

| | | | |
|---|---|---|---|
| 0021384 | 11/1981 | European Pat. Off. | 362/342 |
| 0138747 | 4/1985 | European Pat. Off. | 362/354 |
| 1963803 | 3/1967 | Fed. Rep. of Germany . | |
| 2926202 | 1/1981 | Fed. Rep. of Germany . | |
| 862697 | 3/1941 | France | 362/354 |
| 1570726 | 6/1969 | France . | |

OTHER PUBLICATIONS

"Beleuchtung von Raumen mit Bildschirmarbeitsplatzen", Electrodienst22, 1980.

*Primary Examiner*—Ira S. Lazarus
*Assistant Examiner*—D. M. Cox
*Attorney, Agent, or Firm*—Hill, Van Santen, Steadman & Simpson

[57] ABSTRACT

Interior lighting fixtures having specific shielding conditions. For lighting fixtures having a center-symmetrical light exit area, a structural pattern for a grid inserted into the light exit opening of the lighting fixture is provided which meets the specific shielding conditions of the BAP picture screen workstation condition and the like and which masks the light from the lighting fixture as little as possible. This structural pattern is based on a subdivision of the grid into segments of identical size having self-contained framing cells whose diagonal or whose largest, straight side or, respectively, a chord of the largest, arcuate side does not exceed a value 2 Ro of the diameter of the center grid cell. The size of the center grid cell thereby results from the height of lamellae exhibiting a double-parabolic cross-section while preserving the desired shielding condition for this center grid cell.

14 Claims, 4 Drawing Sheets

GRID OF LAMELLAE FOR A LAMP

BACKGROUND OF THE INVENTION

The invention is directed to a lighting fixture for use in ceilings, an attachment to ceilings, and suspended from ceilings having a box-shaped housing. A grid of lamellae having at least an approximately double-parabolic cross-section connected to one another lattice-like is inserted into a light exit opening at the fixture which, given the lowest possible masking losses of the lamps arranged above the grid in the housing, produces the shielding desired in accordance with the respective demands of the workplace or in the room.

Lighting fixtures of this type are known, for example, from the reference Siemens-Elektrodienst, volume 22, number 3, April 1980, pages 4 and 5. Interior lighting fixtures for picture screen work stations must meet specific shielding conditions according to a BAP condition. The BAP condition realized in these lighting fixtures means that their luminance in the 90° angular range between vertical and horizontal is subdivided into two regions, namely into an emission region having an emission angle gamma equal to 50° and into a dark region having a shielding angle beta equal to 40°. The luminance must remain, below 200 cd/m$^2$ in the dark on the quality of illumination needed for a room without regard to BAP, the division of the 90° angular range into an emission region and a dark region can deviate from the angular values prescribed in the BAP condition.

Given long field lamps, the dark region in the direction perpendicular to the axis of the fluorescent tube is achieved by an appropriately shaped, channel-like reflector having a parabolic cross-section. The dark region in the direction of the axis of the fluorescent tube is achieved by a grid of lamellae having a double-parabolic cross-section inserted into the light exit opening, these lamellae being arranged parallel to one another at mutually identical distances and perpendicular to the axis of the fluorescent tube. Taking the height and the cross-section of the lamellae into consideration, the mutual spacing of the lamellae is selected such that the desired shielding is achieved given the least possible masking of the light of the fluorescent tube.

For achieving an omnidirectional characteristic, such long field lamps meeting a specific shielding condition can in fact be utilized in such fashion that a plurality of long field lamps are annularly arranged in the fashion of an optical conical pattern. However, a ring arrangement is only possible when an adequately large ceiling area is available. Further, lighting fixtures having a rotational-symmetrical light exit opening are known, for example, from the references German utility model 19 63 808 and DE 29 26 202 Al, wherein the light exit opening is provided with a rotational-symmetrical lattice-shaped grid. These grids, however, have only a decorative effect and do not meet any specific shielding conditions.

SUMMARY OF THE INVENTION

An object of the present invention is to provide for a lighting fixture having an omnidirectional characteristic a grid of lamellae having at least an approximately double-parabolic cross-section connected to one another lattice-like which meets specific shielding conditions like the BAP condition, namely having the least possible masking losses of the lamp light.

For lighting fixtures having a center-symmetrical light exit area, a structural pattern for a grid inserted into the light exit opening of the lighting fixture is provided which meets the specific shielding conditions like the BAP picture screen workstation condition and which masks light from the lighting fixture as little as possible. This structural pattern is based on a subdivision of the grid into segments of identical size having self-contained framing cells whose diagonal or whose largest, straight side or, respectively, a chord of the largest, arcuate side does not exceed a value 2 Ro of the diameter of the center grid cell. The size of the center grid cell thereby results from the height of lamellae exhibiting a double-parabolic cross-section while preserving the desired shielding condition for this center grid cell.

The invention provides the desired grid structure composed of a lamella assembly having lamellae that have at least approximately double-parabolic cross-section. The grid structure can be made in an extraordinarily simple manner by providing an annular center grid cell meeting the desired shielding condition and providing a sub-division of the center-symmetrical grid into mutually identical segments.

BRIEF DESCRIPTION OF THE DRAWINGS

The features of the present invention which are believed to be novel, are set forth with particularity in the appended claims. The invention, together with further objects and advantages, may best be understood by reference to the following description taken in conjunction with the accompanying drawings, in the several Figures in which like reference numerals identify like elements, and in which:

DESCRIPTION OF THE PREFERRED EMBODIMENT

Figure 1:
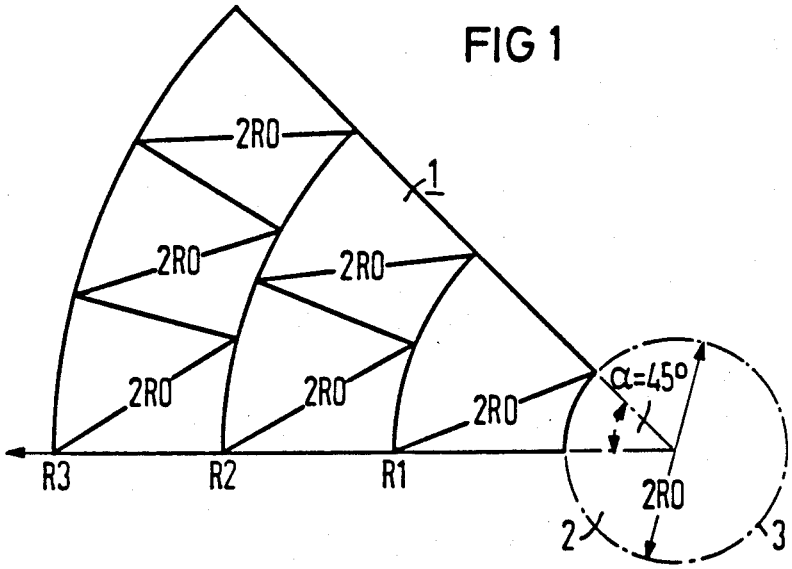
FIG. 1 is a schematic illustration of a first basic structure for a center-symmetrical grid meeting specific shielding conditions like the BAP condition.

A pattern for constructing a center-symmetrical grid as shown in FIG. 1 makes use of a segment 1 having a segment angle alpha equal to 45°. The center grid cell 2 shown with a dotted line and having the segment portion likewise only indicated with a dotted line has a diameter 2 Ro. This diameter 2 Ro meets the desired shielding condition of the BAP condition for this center grid cell 2 given a prescribed height and design of the ring lamellae 3 having a double-parabolic cross-section, i.e. the light from the light bulbs arranged above the grid can only directly emerge from this center grid cell with an emission angle gamma, that is, 90° less the shielding angle beta, The design of the lamella double-parabolic cross-section also provides that a mirror image of the light is also prevented from emerging from the center grid cell at an angle exceeding the emission angle gamma.

Given the structural pattern of the grid shown in FIG. 1, the desired shielding condition is met for every framing cell, as indicated in FIG. 1., when the diagonal of a framing cell does not exceed the value 2 Ro. Optimum conditions for the lowest possible masking losses of the light of the lighting fixture by the grid are achieved when the diagonals of the framing cells exhibit exactly the value 2 Ro.

Figure 2:
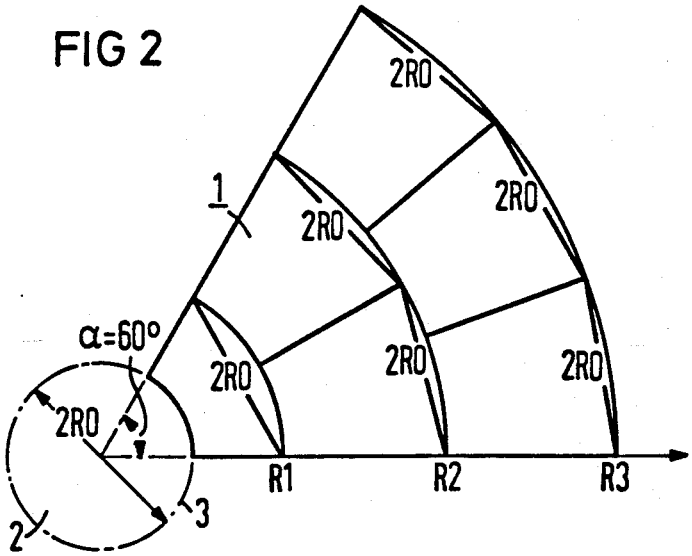
FIG. 2 is a schematic illustration of a second basic structure for a center-symmetrical grid meeting specific shielding conditions of the BAP condition.

The structural pattern shown in FIG. 2 for such a center-symmetrical grid is based on a segment 1 having a segment angle, alpha=60°. The desired shielding condition is optimally met here when the chord of the respectively largest arc side of a framing cell has a length equal to 2 Ro.

The radii R1, R2, R3 for the subdivision of the segment derive for the two segments 1 of FIGS. 1 and 2 are determined on the basis of either the diagonal or the chord of the largest, arcuate side of a framing cell having the value 2 Ro.

The radii can be calculated as follows. Based on the value of Ro and alpha for the radii $R_i$, the relationship $$R_i = R_{i-1} \cdot \cos\frac{\alpha}{i} + \sqrt{4Ro^2 - R_{i-1}^2 \sin^2\frac{\alpha}{i}} \text{ for } i = l \ldots n$$

is used for the structural pattern of FIG. 1. Based on the value of Ro and alpha for the radii Ri, the relationship $R_i$=Ro/sin (alpha/2i) is used for the structural pattern of FIG. 2.

Figure 3:
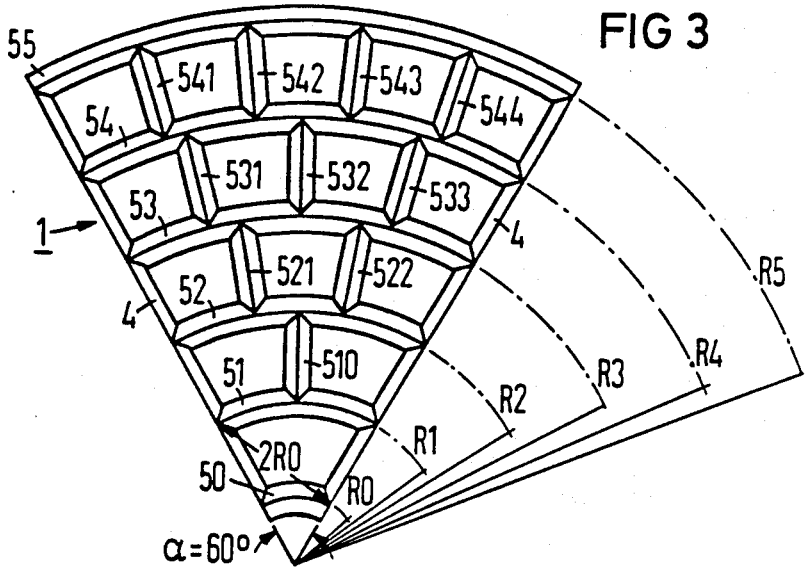
FIG. 3 is a grid segment designed in accord with the pattern of FIG. 1.

FIG. 3 shows a segment 1 having a segment angle alpha=60°, which is designed in accordance with the structural pattern of FIG. 1. The closed framing cell structure of this segment has two principle radial lamellae 4 which are connected to one another via 6 connecting lamellae 50, 51, 52, 53, 54 and 55 representing circular arc segments having the radii R0, R1, R2, R3, R4 and, R5 respectively. For further subdivision of the annular segments, defined by the principle radial lamellae and the connecting lamellae, into framing cells having diagonals with a size 2 Ro, radial intermediate lamellae 510, 521 and 522, 531 through 533 and 541 through 544 are further provided.

Figure 4:
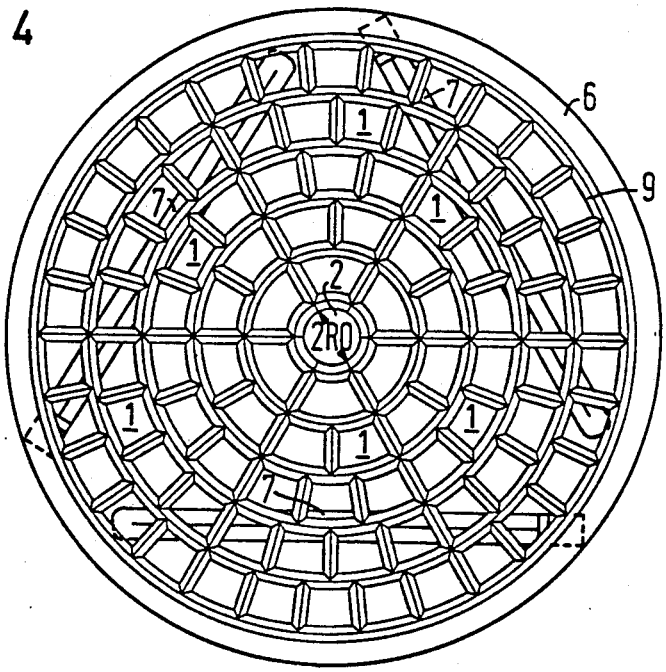
FIG. 4 is a plan view of a first embodiment of a lighting fixture having a center-symmetrical grid assembled from segments of FIG. 3.

A rotational-symmetrical grid 9 fashioned of 6 segments 1 of FIG. 3 which fills out the light exit opening of the housing 6 is provided in a lighting fixture having a rotational-symmetrical light exit opening as shown in FIG. 4. Three compact fluorescent tubes 7 fitted with bases at one side are provided in a triangular configuration in the housing 6 above the grid 9. According to FIG. 3, the center grid cell 2 has the diameter 2 Ro.

Figure 5:
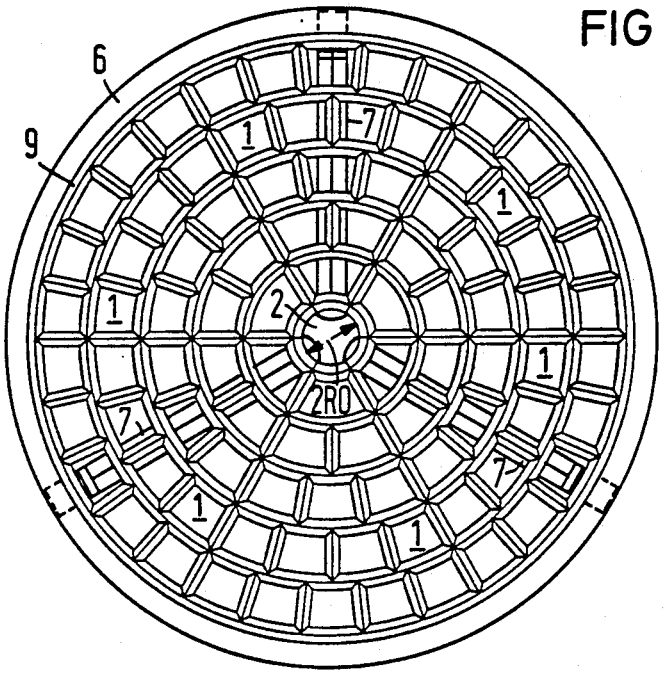
FIG. 5 is a plan view of a second embodiment of a lighting fixture having a center-symmetrical grid assembled of segments according to FIG. 3.
Figure 6:
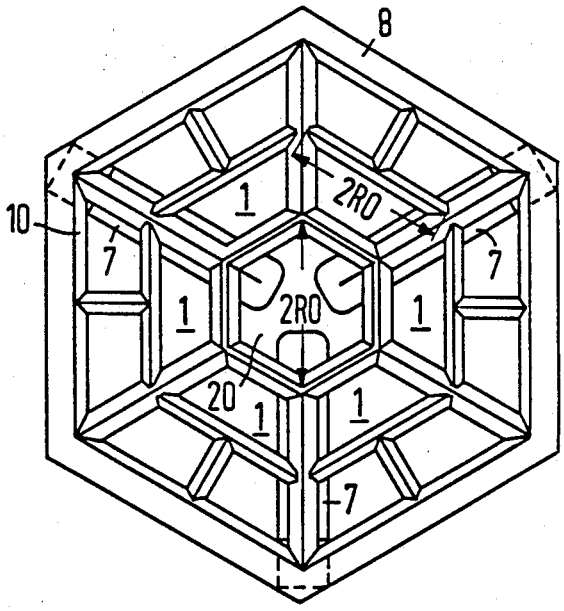
FIG. 6 is a plan view of a further embodiment of a lighting fixture having a center-symmetrical grid in the form of an equilateral hexagon.

The rotational-symmetrical lighting fixture of FIG. 5 corresponds to the lighting fixture of FIG. 4 both in terms of dimensions as well as in terms of the design of the grid 9. It likewise has 3 compact fluorescent tubes 7 fitted with bases at one side which, however, are arranged star-shaped in the housing 6 with mutually identical angular spacings of 120°. Center-symmetrical grids need not be rotational-symmetrical but can also have the shape of an equilateral polygon, such as the pattern format of FIG. 2. FIG. 6 shows a lighting fixture having a center-symmetrical light exit opening of a housing 8 which represents an equilateral hexagon and whose grid 10 consists of 6 segments 1 having a segment angle of alpha=60°. The center grid cell 20 which here likewise represents an hexagonal framing cell again has the maximum diameter 2 Ro. In the same way, the greatest length of a straight framing side of a framing cell has the value 2 Ro. The lighting fixture of FIG. 6 also has three compact fluorescent tubes 7 fitted with bases at one side which are arranged star-shaped in the housing 8 in accordance with the compact fluorescent tubes 7 of the lighting fixture of FIG. 5. This is also used in the embodiment of FIG. 6. That is, as FIG. 6 shows, both the intermediate lamellae arranged between the radial main lamellae, as well as, the radial intermediate lamellae proceedings from these intermediate lamellae to the housing 8 are reduced in height between the main lamellae.

Figure 7:
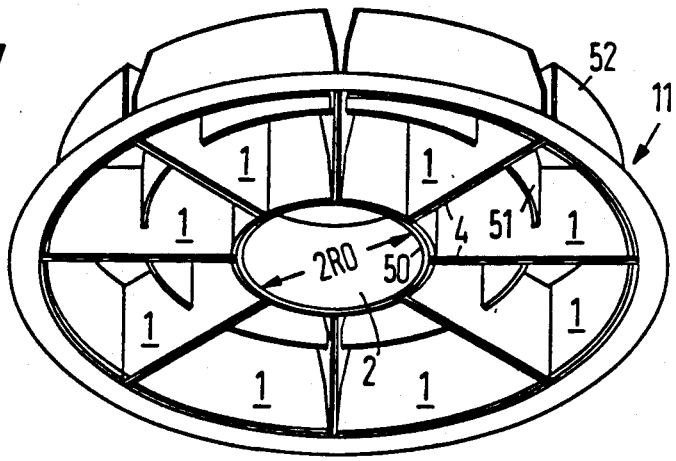
FIG. 7 is a perspective view of a further embodiment of a center-symmetrical grid having individual lamellae differing in height.

Finally, FIG. 7, shows a perspective view of a rotational-symmetrical grid 11 having eight segments 1 having a segment angle alpha=45°. The principle radial lamellae 4 are thereby respectively connected to one another by connecting lamellae 50, 51 and 52 is further provided exclusively representing three circular arcs. Given this grid, the framing cells cannot be optimized in view of the value 2 Ro because the overall diameter of the grid is prescribed by the light exit opening of the lighting fixture to which it is allocated. A subdivision of the cell formed by the principal radial lamellae 4, as well as by the connecting lamellae 50 and 52 is further provided by the connecting lamella 51 which is required because the framing cell would otherwise become too large, i.e. both the diagonal as well as the chord of the largest arcuate framing side here exceeds the value 2 Ro. The subdivision with the connecting lamellae 51 in turn yields framing cell sizes whose diagonal or whose chord of the largest arcuate side significantly falls below the value 2 Ro. As shown in FIG. 7, the grid is designed to provide the desired shielding condition. In order to mask the light of the lighting fixture as little as possible the connecting lamella 51 are selected lower in height than the remaining lamellae. The arrangement is such that the connecting lamellae 51 have their foot end arranged in the plane that is defined by the broad ends at the foot side of the remaining lamellae of the lamella assembly. The shortened lamellae have their head side arranged above the plane that is defined by the narrow ends at the head side of the remaining lamellae.

Such a design can always be utilized when, due to the prescribed dimensions, the framing cells of the grid cannot be optimized for the value 2 Ro. With reference to a segment of the grid having a lamella assembly yielding a self-contained framing cell structure, a lamella shortened in height can thereby be provided between two lamellae of identical height following one another. The shortened lamella proceeds perpendicular to the radial direction or perpendicular to the circumferential direction, that is leaving the principle radial lamellae out of consideration. All intermediate lamellae proceeding in a radial direction and adjacent to a shortened connecting lamellae are likewise shortened.

In the exemplary embodiment of FIG. 7, the shortened lamellae are the connecting lamellae 51. As soon as a segment is subdivided into more than two framing cells and the shortening of a connecting lamellae is thereby used, the intermediate lamellae adjacent to this shortened connecting lamella, are to be correspondingly shortened such as referenced lamellae 510,521,522,531,532,533 as well as 541,542,543,544 in FIG. 3.

Figure 8:
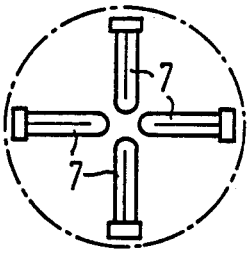
FIGS. 8, 9 and 10 are diagrams of various light bulb arrangements use in lighting fixtures of FIGS. 4, 5, 6 and 7.
Figure 9:
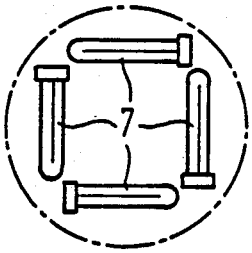
Figure 10:
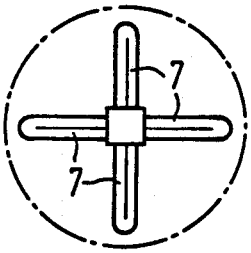

Further advantageous arrangements of lights in a light housing having a center-symmetrical light exit opening are shown in FIGS. 8–10. Differing from the lighting fixtures of FIGS. 4–7, four compact fluorescent tubes 7 fitted with bases at one side are respectively provided herein. In FIG. 8 and FIG. 10, this quadruple arrangement represents a center-symmetrical cross. The two figures differ in that the compact fluorescent tubes 7 in FIG. 8 are fitted with bases at the housing circumference and those in the embodiment of FIG. 10 are fitted with bases in the center of the housing. Given the quadruple arrangement of FIG. 9, the four compact fluorescent tubes 7 fitted with bases at one side form a square.

The lighting fixture of the invention can be utilized as an office lighting fixture in a great variety of modifications with respect to embodiment and equipment.

The invention is not limited to the particular details of the apparatus depicted and other modifications and applications are contemplated. Certain other changes may be made in the above described apparatus without departing from the true spirit and scope of the invention herein involved. It is intended, therefore, that the subject matter in the above depiction shall be interpreted as illustrative and not in a limiting sense.

What is claimed is:

1. A lighting fixture for integration in ceilings, attachment to ceilings and suspended from ceilings, having a box-shaped housing, a grid of lamellae having at least approximately double-parabolic cross-section connected lattice-like to one another and inserted into a light exit opening and which, for the lowest possible masking losses of light of light bulbs arranged above the grid in the housing, produces the shielding desired in accord with the respective demands of a workplace comprising:

for a center-symmetrical light exit opening, a center-symmetrical grid composed of segments of identical size having a segment angle alpha of 360/n degrees, where n is a whole, positive number; and with reference to an annular center grid cell having a diameter 2 Ro which optimally meets the desired masking condition given the lowest possible masking losses, a framing-cell-like subdivision of the segments is provided such that, while preserving the center symmetry of the grid, the framing cells do not exceed the value 2 Ro in their dimensions either in a diagonal either in the largest, straight framing side, either, respectively, in the chord of the largest, arcuate framing side, the surface area dimensions of the framing cells being optimally large and optimally identical with reference to the value 2 Ro;

wherein the dimension of the light opening determines the framing-cell-like subdivision of the segments to produce framing cells whose diagonals and whose largest, straight framing side or, respectively, chord length of the largest, arcuate frame side significantly fall below the value 2 Ro, with reference to a segment of the grid having a lamellae union yielding a self-contained framing cell structure, a lamellae shortened in height is provided between two lamellae of identical height following one another which proceed perpendicular to the radial direction or perpendicular to the circumferential direction, leaving the principle radial lamellae out of consideration, whereby all intermediate lamellae proceeding in radial direction and adjacent to a shortened connecting lamellae connecting the two principle radial lamellae to one another are likewise shortened; these shortened lamellae having their free, narrow ends at a head side arranged above the plane that is defined by the free, narrow ends at the head side of the remaining lamellae of the lamella assembly.

2. The lighting fixture according to claim 1, wherein the shortened lamellae have their foot side arranged in the plane that is defined by the broad ends at the foot side of the remaining lamellae of the lamella assembly.

3. A lighting fixture for use in a ceiling, the lighting fixture having a housing, having a grid of lamella with at least approximately double-parabolic cross-section connected lattice-like to one another and inserted into a center-symmetrical light exit opening in the housing and having light bulbs arranged above the grid in the housing, comprising:

the grid being center-symmetrical and composed of segments of substantially identical size having a segment angle alpha of 360/n degrees, where n is a whole, positive number;

the grid having an annular center grid cell having a diameter of 2Ro; and a framing-cell-like subdivision of the segment having a size dimension not exceeding 2Ro, the size dimension of the subdivision being a diagonal of the subdivision.

4. The lighting fixture according to claim 3, wherein the center-symmetrical grid is rotational-symmetrical.

5. The lighting fixture according to claim 3, wherein the center-symmetrical grid has the shape of an equilateral polygon.

6. A lighting fixture for use in a ceiling, the lighting fixture having a housing, having a grid of lamella with at least approximately double-parabolic cross-section connected lattice-like to one another and inserted into a center-symmetrical light exit opening in the housing and having light bulbs arranged above the grid in the housing, comprising:

the grid being center-symmetrical and composed of segments of substantially identical size having a segment angle alpha of 360/n degrees, where n is a whole, positive number;

the grid having an annular center grid cell having a diameter of 2Ro; and a framing-cell-like subdivision of the segment having a size dimension not exceeding 2Ro, the size dimension of the subdivision being a largest, straight framing side of the subdivision.

7. The lighting fixture according to claim 6, wherein the center-symmetrical grid is rotational-symmetrical.

8. The lighting fixture according to claim 6, wherein the center-symmetrical grid has the shape of an equilateral polygon.

9. A lighting fixture for use in a ceiling, the lighting fixture having a housing, having a grid of lamella with at lest approximately double-parabolic cross-section connected lattice-like to one another and inserted into a center-symmetrical light exit opening in the housing and having light bulbs arranged above the grid in the housing, comprising:

the grid being center-symmetrical and composed of segments of substantially identical size having a segment angle alpha of 360/n degrees, where n is a whole, positive number;

the grid having an annular center grid cell having a diameter of 2 Ro; and a framing-cell-like subdivision of the segment having a size dimension not exceeding 2Ro; and the size dimension of the subdivision being a chord of a largest, arcuate framing side.

10. A lighting fixture for use in a ceiling, the lighting fixture having a housing, having a grid of lamella with at least approximately double-parabolic cross-section connected lattice-like to one another and inserted into a center-symmetrical light exit opening in the housing and having light bulbs arranged above the grid is the housing, comprising:

the grid being center-symmetrical and composed of segments of substantially identical size having a segment angle alpha of 360/n degrees, where n is a whole, positive number;

the grid having an annular center grid cell having a diameter of 2 Ro;

a framing-cell-like subdivision of the segment having a size dimension not exceeding 2Ro; and the segment having two principal radial lamellae of identical height extending in a radial direction from the center grid cell to the housing, at least one shortened lamella provided between the two principal radial lamella, the shortened lamella having its free, narrow end at a head side arranged above the plane that is defined by the free, narrow ends at the head side of the two principal radial lamellae.

11. The lighting fixture according to claim 10, wherein the shortened lamellae proceeds perpendicular to the radial direction of the grid.

12. The lighting fixture according to claim 10, wherein the shortened lamella proceeds perpendicular to the circumferential direction of the grid.

13. The lighting fixture according to claim 10, wherein all intermediate lamella proceeding in a radial direction and adjacent to a shortened connecting lamella connecting the two principal radial lamellae to one another are likewise shortened.

14. The lighting fixture according to claim 10, wherein the shortened lamellae have their foot side arranged in the plane that is defined by the broad ends at the foot side of the remaining lamellae of the lamella assembly.

* * * * *